US008821645B2

(12) United States Patent
Hentges

(10) Patent No.: US 8,821,645 B2
(45) Date of Patent: Sep. 2, 2014

(54) COSMETIC REMOVAL APPARATUS

(76) Inventor: Mari Kay Hentges, Carver, MN (US)

( * ) Notice: Subject to any disclaimer, the term of this patent is extended or adjusted under 35 U.S.C. 154(b) by 883 days.

(21) Appl. No.: 13/019,826

(22) Filed: Feb. 2, 2011

(65) Prior Publication Data

US 2012/0192374 A1 Aug. 2, 2012

(51) Int. Cl.
*B08B 7/00* (2006.01)
*A45D 40/00* (2006.01)
*A45D 44/00* (2006.01)

(52) U.S. Cl.
CPC ..... *A45D 40/00* (2013.01); *A45D 2200/1063* (2013.01); *A45D 44/00* (2013.01)
USPC ..... 134/6; 134/40

(58) Field of Classification Search
None
See application file for complete search history.

(56) References Cited

U.S. PATENT DOCUMENTS

2010/0199450 A1* 8/2010 Linzell ..... 15/209.1
2010/0242201 A1* 9/2010 Linzell ..... 15/229.11

* cited by examiner

*Primary Examiner* — Eric Golightly
(74) *Attorney, Agent, or Firm* — Mark A. Litman & Associates, P.A.

(57) ABSTRACT

A method of removing makeup from skin of humans comprising providing a system comprising: multiple, individual conical elements having an at least adsorbing surface; at least some of the individual conical elements each seated in contact with a respective underlying next individual conical element as an upper and a lower pair of individual conical elements; contacting a tip of an uppermost individual conical element with skin adjacent to an area of skin having makeup thereon; moving the tip into contact with makeup; wiping off and at least adsorbing excess makeup onto the tip; and removing the uppermost individual conical element with makeup at least adsorbed thereon from contact with the skin and from seating with the next individual conical element to expose an at least adsorbing surface of the next individual conical element without any makeup being present on the exposed surface of the next individual conical element.

13 Claims, 1 Drawing Sheet

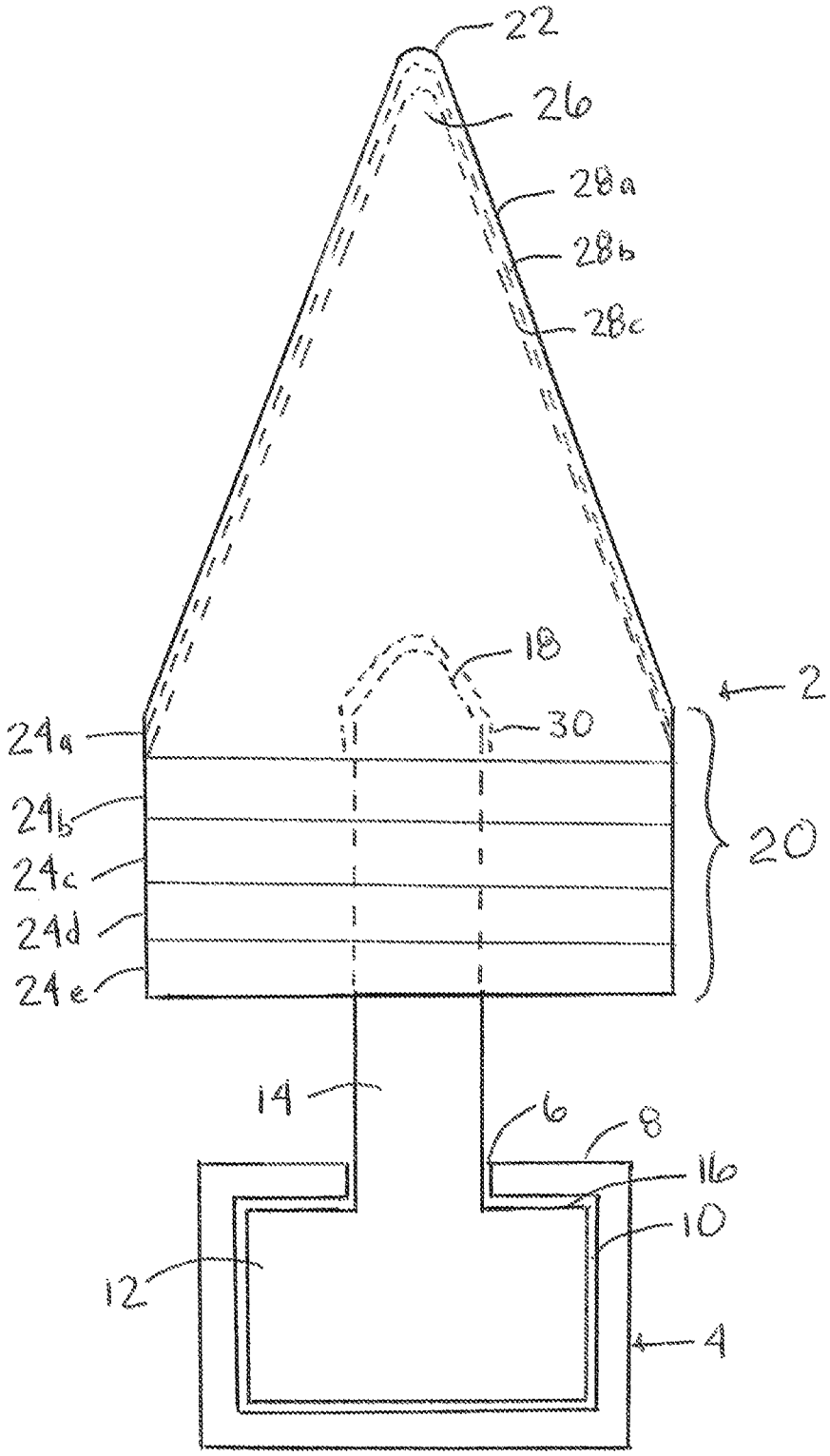
22
26
28a
28b
28c
18
30
2
24a
24b
24c
24d
24e
20
14
6
8
16
10
12
4

COSMETIC REMOVAL APPARATUS

BACKGROUND OF THE INVENTION

1. Field of the Invention

The present invention relates to the removal of makeup and a system of supplying materials to assist in the removal of makeup by manual wiping or wiping with chemicals applied while using the materials.

2. Background of the Art

When persons remove or correct the application of makeup, it has been standard practice for centuries for the person wearing the makeup to use one of their fingers (with or without a fabric or paper covering the finger) to carefully wipe or sculpt the makeup to clean off loose material and assure even and accurate placement of the makeup. The makeup may be lipstick, rouge, base, coverup, shadow, mascara and the like. Sometimes, stick elements (sharp pointed wooden elements) have been used as tools to scrape There is a problem in using the sticks in that they may be used only once because of buildup on the stick and the possibility that one form and color of makeup may be carried from one application to the next.

SUMMARY OF THE INVENTION

A system provides individual makeup removing elements with:

multiple, individual conical elements having an at least adsorbing surface;

at least some of the individual conical elements seated in contact with an underlying next individual conical element as an upper and a lower pair of individual conical elements;

each upper individual conical element being separable from the lower individual conical element without damage to a next lower individual conical element; and each individual conical element being capable of at least adsorbing microcrystalline wax (e.g., having a melting point between 120° F. and 140° F.) on an upper surface of an upper individual conical element without transferring any microcrystalline wax to the next lower individual conical element (when the wax is melted and pressed against the surface on an individual element); and each individual conical element has a tip. The absorbable microcrystalline wax, for example, may be required to be absorbed into the element at a volume of at least 0.1 grams wax per $cm^2$ of microcrystalline wax/element surface,

BRIEF DESCRIPTION OF THE FIGURES

FIG. 1 shows a side view of a system according to the present invention with a supporting base.

DETAILED DESCRIPTION OF THE INVENTION

A system provides individual makeup removing elements. The system has multiple, individual conical elements having an at least adsorbing surface. There are at least some of the individual conical elements seated in contact with an underlying next individual conical element as an upper and a lower pair of individual conical elements. Each upper individual conical element is separable from the lower individual conical element without damage to a next lower individual conical element. Each individual conical element is capable of at least adsorbing 0.1 grams/$cm^2$ of microcrystalline wax/element surface having a melting point between 120° F. and 140° F. on an upper surface of an upper individual conical element without transferring any microcrystalline wax to the next lower individual conical element.

The terminology of "at least adsorbent" means that the surface of the conical elements will allow at least some of the cosmetics to adhere sufficiently strongly to the surface that they cosmetics can be wiped and lifted from the skin, teeth or gums of the user. Preferably the composition of the surface may be at least slightly absorbent of the cosmetic composition. Each individual conical element has a tip. The elements may be stacked on a stem. The system may have each individual conical element constructed of various materials with specifically selected properties for various types of makeup. For example, the individual conical elements may be constructed of a paper (natural or synthetic) material, a foam material (e.g., acrylic, polyurethane, polyolefin such as polystyrene, polysiloxane, or other synthetic polymer) or a reticulated foam material.

The system may provide all of the multiple, individual conical elements supported on a stem so that the stem can apply pressure to a tip of an outermost individual conical element. When the stem is gripped, for example, pressure is extended from the stem through the elements. The stem may be connected to a support base, and the support base may be engaged with a stand. The stem may also be extended from a tube, similar to the provision of lipstick from a tube. The individual conical elements may then be stripped off the stem. When the supply is exhausted, a new supply of a stem with stacked elements on it may be provided for the tube, or the entire tube can be replaced.

In one construction, the stem securely and releasably engages a stack of the multiple, individual conical elements.

The system can be used in a method whereby makeup is removed from skin of humans by first providing the system as described. Then the user contacts the tip of an uppermost individual conical element with skin adjacent to an area of skin having makeup thereon; moves the tip into contact with makeup that is in excess of a desired amount on the skin; wipes off and at least adsorbing excess makeup onto the tip; and removes the uppermost individual conical element with makeup at least adsorbed thereon from contact with the skin and from seating with the next individual conical element to expose an at least adsorbing surface of the next individual conical element without any makeup being present on the exposed surface of the next individual conical element.

A look at the FIGURE will assist in further understanding the present technology.

FIG. 1 shows a cosmetology cleaning system 2 as described herein. The system 2 is shown with a stem 14 supporting an array 20 of individual conical wiping elements 14*a*, 24*b*, 24*c*, 24*d* and 24*e*. The uppermost element 24*a* has its surface 28*a* exposed for use in a wiping process. The surfaces of some of the underlying conical elements 24*b* and 24*c* are shown as surfaces 28*b* and 28*c* below the uppermost conical element surface 28*a*.

The stem 14 is supported on a firm base 12 that is engaged with a support base 4. The support base 4 is open and the firm base 12 is slid into the opening 10 of the support base 4. The stem 14 slides through opening neck 6 and the firm base 12 slides through the main opening 10. A top portion 16 of the firm base 12 nests within a restrictive top plate 8 on the support base 4.

The stack 20 or array of the multiple, individual conical elements 24*a*-24*e* is shown as a stack of five elements, but fewer or greater numbers of elements may be provided. A tip 18 of the stem 14 is shown engaged with (e.g., snap fit, screwed, wedged, adhered etc.) an internal cavity 10 that is provided with the stack 20. The array or stack may be replaced (when defective or empty) by removing the stack 20 by separating the tip 18 of the stem 14 from the cavity 30 and replacing an entire stem/array component.

The cosmetics that are particularly objects of the use of these systems include, but are not limited to the coloring or shading make-ups such as lip waxes, lipsticks, lip gloss, tints, foundation, base, eye shadow, sparkle and the like. When materials pass by the lips and contact the teeth, the systems may also be used to remove the cosmetics from the teeth and/or gums of the user.

What is claimed:

1. A method of removing makeup from skin of humans comprising providing a system for providing individual makeup removing elements comprising: multiple, individual conical elements having an at least adsorbing surface; at least some of the individual conical elements each seated in contact with a respective underlying next individual conical element as an upper and a lower pair of individual conical elements; each upper individual conical element being separable from the lower individual conical element without damage to a next lower individual conical element; each individual conical element being capable of at least adsorbing melted microcrystalline wax on an upper surface of an upper individual conical element without transferring any microcrystalline wax to the next lower individual conical element; and each individual conical element having a tip, contacting the tip of an uppermost individual conical element with skin adjacent to an area of skin having makeup thereon;

moving the tip into contact with makeup that is in excess of a desired amount on the skin;

wiping off and at least adsorbing excess makeup onto the tip; and removing the uppermost individual conical element with makeup at least adsorbed thereon from contact with the skin and from seating with the next individual conical element to expose an at least adsorbing surface of the next individual conical element without any makeup being present on the exposed surface of the next individual conical element.

2. The method of claim 1 wherein each individual conical element comprises a paper material.

3. The method of claim 1 wherein each individual conical element comprises a foam material.

4. The method of claim 1 wherein each individual conical element comprises a reticulated foam material.

5. The method of claim 1 wherein all of the multiple, individual conical elements are supported on a stem so that the stem can apply pressure to a tip of an outermost individual conical element and the amount of microcrystalline wax absorbable into the element comprises 0.1 grams/cm$^2$ of microcrystalline wax having a melting point between 120° F. and 140° F.

6. The method of claim 5 wherein the stem is connected to a support base, and the support base is engaged with a stand.

7. The method of claim 6 wherein the stem securely and releasably engages a stack of the multiple, individual conical elements.

8. The method of claim 6 wherein each individual conical element comprises a paper material.

9. The method of claim 5 wherein each individual conical element comprises a foam material.

10. The method of claim 9 wherein each individual conical element comprises a reticulated foam material.

11. The method of claim 2 wherein all of the multiple, individual conical elements are supported on a stem so that the stem can apply pressure to a tip of an outermost individual conical element and the amount of microcrystalline wax absorbable into the element comprises 0.1 grams/cm$^2$ of microcrystalline wax having a melting point between 120° F. and 140° F.

12. The method of claim 3 wherein all of the multiple, individual conical elements are supported on a stem so that the stem can apply pressure to a tip of an outermost individual conical element and the amount of microcrystalline wax absorbable into the element comprises 0.1 grams/cm$^2$ of microcrystalline wax having a melting point between 120° F. and 140° F.

13. The method of claim 4 wherein all of the multiple, individual conical elements are supported on a stem so that the stem can apply pressure to a tip of an outermost individual conical element and the amount of microcrystalline wax absorbable into the element comprises 0.1 grams/cm$^2$ of microcrystalline wax having a melting point between 120° F. and 140° F.

* * * * *